US005809821A

United States Patent [19]

Figge

[11] Patent Number: 5,809,821

[45] Date of Patent: Sep. 22, 1998

[54] ROLL STAND WITH BACKING ROLLS AND WORK ROLLS

[75] Inventor: Dieter Figge, Essen, Germany

[73] Assignee: Mannesmann Aktiengesellschaft, Düsseldorf, Germany

[21] Appl. No.: 854,740

[22] Filed: May 12, 1997

[30] Foreign Application Priority Data

May 20, 1996 [DE] Germany ..... 196 22 305.9

[51] Int. Cl.[6] ..... B21B 31/07

[52] U.S. Cl. ..... 72/247; 72/245

[58] Field of Search ..... 72/237, 245, 247, 72/241.2, 241.4, 241.8

[56] References Cited

U.S. PATENT DOCUMENTS

| | | | |
|---|---|---|---|
| 4,727,741 | 3/1988 | Ushifusa et al. | 72/241.2 |
| 4,770,021 | 9/1988 | Kobayashi et al. | 72/241.4 |
| 5,365,764 | 11/1994 | Kajiwara et al. | 72/241.2 |

FOREIGN PATENT DOCUMENTS

| | | | |
|---|---|---|---|
| 0 525 552 | 2/1993 | European Pat. Off. . | |
| 1-83312 A | 3/1989 | Japan | 72/247 |
| 4-6031304 A | 2/1994 | Japan | 72/241.8 |

*Primary Examiner*—Lowell A. Larson
*Assistant Examiner*—Rodney Butlar
*Attorney, Agent, or Firm*—Cohen, Pontani, Lieberman & Pavane

[57] ABSTRACT

A roll stand with backing rolls and work rolls for rolling sheets and strips, in which at least the upper and lower work rolls mounted in chucks inside of housing windows formed between housing columns of the roll housing can be moved out of their shared vertical plane horizontally in opposite directions by movement drives effectively associated with the roll chucks into positions wherein the vertical planes that pass through the axis of roll of the upper work roll and of the lower work roll intersect. This is achieved by the fact that on the inner and outer sides (which are opposite to each other and run parallel to the direction of roll) of each housing column, a movement and a swivel bearing are arranged for one of two substantially horizontal beams. The beams are parallel, connected to each other and extend on both sides past the housing columns on one side, the beams extend into the housing window and, on the side facing away from the housing window, out of the roll housing. The respective ends of two beam pairs extending into the housing windows on one housing side support the chucks of the upper and the lower work roll so that the chucks are synchronously adjustable on both sides in the vertical and the horizontal directions. The other protruding ends of the beam pairs connect to the movement devices and to deflecting devices.

8 Claims, 5 Drawing Sheets

ROLL STAND WITH BACKING ROLLS AND WORK ROLLS

BACKGROUND OF THE INVENTION

1. Field of the Invention

The invention relates to a roll stand with backing rolls and work rolls for rolling sheets and strips. At least the upper and lower work rolls, which are mounted in chucks inside of housing windows formed between housing columns of the roll housings, can be moved horizontally in opposite directions by means of movement drives effectively associated with the chucks, out of their shared vertical plane into positions wherein the vertical planes that pass through the axis of roll of the upper work roll and of the lower work roll intersect.

2. Description of the Related Art

Systems in which the upper and lower rolls of a four-high roll stand are swivelled in opposite directions are known. By crossing the rolls and intersecting their axes of roll, it is possible (if necessary, in conjunction with additional work roll transverse forces) to adjust the profile of the rolling material. One resulting advantage is a larger range for setting the rolling material profile.

A great variety of solutions for adjusting the roll pairs have been proposed. European patent application EP 0 525 552 A1 suggests shared movement blocks for the chucks of the work rolls and the backing rolls. The movement blocks are arranged between the chucks and the roll housing and have, on a side facing away from the chucks, wedge areas that correspond to similar wedge areas on vertically-adjustable movement drives. When the movement drives are adjusted, the wedge areas, which glide one atop the other, cause the movement blocks to move horizontally. As a result, the movement blocks adjust the laterally adjacent chucks.

Other adjustment drives are also known from EP 0525552 A1 . For example, hydraulic cylinders and spindles that act mechanically on the chucks. These drives move the chucks horizontally for the purpose of changing the roll positions inside the housing window.

The known systems are very complicated, especially when, in addition to moving the rolls, they provide devices to deflect the rolls. Such devices usually require special work roll bearings. The roll sets must be equipped with axial fastenings to be able to absorb the axial forces created by the slanted position that the system requires of the rolls. It is not possible, or it is possible only at unacceptable expense, to retrofit existing roll stands with systems to cross and deflect the work rolls.

SUMMARY OF THE INVENTION

Starting from the prior art as described, for example, by EP 0 525 552 A1 , the object of the present invention is to provide, on a roll stand with backing rolls and work rolls for rolling sheets and strips, a device for crossing and deflecting the work rolls, which device can be easily retrofitted, even onto existing rolling mills, while avoiding expensive mechanisms.

Pursuant to this object, one aspect of the present invention resides in arranging a movement bearing and a swivel bearing for one of two substantially horizontal beams on the inner and outer sides of each housing column. These inner and outer sides lie opposite to each other and run parallel to the direction of roll. The substantially horizontal beams, which are parallel and connected to each other, extend past the housing column on both sides. On one side, the beams extend into the housing window. On the side facing away from the housing window, the beams extend out of the housing. The ends of the two beam pairs that extend into the housing windows support the chucks of the upper and lower work rolls so that the chucks are synchronously adjustable on both sides in both the vertical and the horizontal directions. The other protruding ends of these beam pairs correspond to the movement devices and to deflecting devices that, arranged between the roll housing and the beams, move the beams in opposite directions in the movement bearings and/or swivel the beams around the swivel axes of the swivel bearings.

With the invention, which has movable and swivelling beams running externally on the housing, a very simple system that acts upon the chucks in the sense of a horizontal and a vertical movement is provided. The transverse forces are produced on the outer sides of the stand and transmitted into the housing via the swivel bearing of the beams. Movement bearings for the beams are also provided in the region of these swivel bearings, so that a mechanically simple system is created. The particular advantage of this is that the entire device can be retrofitted onto existing roll stands.

Preferably, each movement and swivel bearing consists of guide bushes that can be swiveled around their central horizontal axes. The guide bushes are arranged on the housing columns in an axis-parallel manner and with the same axis relative to a housing column. Each guide bush is centrally penetrated at a right angle by a recess, which leads from one of the beams in the longitudinal direction on both sides. The guide bushes have cylindrical outer surfaces that run in a gliding fashion in bearing sections or shells on both sides of the beam longitudinal axes. The bearing sections are located in bearing blocks arranged on the housing columns.

The guide bushes that constitute the swivel bearing are very sturdily constructed and also hold the bearing for the back-and-forth movement of the beams in the horizontal direction. The bearing blocks for supporting the guide bushes on the housing columns can be attached by retrofitting.

According to another feature of the invention, deflecting cylinders are provided to deflect the work rolls. The deflecting cylinders are arranged in a gliding fashion. On one side, the deflecting cylinders are arranged on a bracket on the housing column, and on the other side, they are arranged on the beams. The transverse forces are transmitted to the housing columns via the guide bushings and the bearing sections or shells. The deflecting cylinders act vertically upon the end of each beam extending outward from the region of the housing columns, regardless of the movement setting of the beam in question. The beam constitutes a two-armed lever. To ensure that the beams move, the deflecting cylinder ends facing a beam are supported on the beam in a gliding fashion.

Preferably, a pair of beams is connected to one of the housing columns by means of traverses extending on both sides of the housing column at a right angle to the beams. This creates a stable closed system, which is also able to transmit large forces.

In another embodiment of the invention the guide bushes on both sides of each swivel and movement bearing are arranged on a shared axle. The shared axle penetrates the housing column and goes through a slot in the beam that runs in the movement direction of the beam. The shared axle, embodied as a pressure-operated tension bar, braces and clamps the beams of the beam pair relative to each other. The axle that connects the two guide bushes is inserted through a bore in each housing column of the roll stand and serves, at the same time, to clamp the beams in the guide bushes. To this end, a pressure-medium cylinder is placed on the front of the axle embodied as a tension bar. This pressure-medium cylinder is used to apply axial clamping force against an abutment located at the other end of the tension bar. The clamping can be supported by means of spring assemblies.

In still a further embodiment of the invention, for the purpose of moving the work rolls in the horizontal direction, the housing columns of the roll stand are penetrated in the direction of roll. These housing columns thus constitute guides for movable beams that extend horizontally into the housing window. In each case, two coaxially opposite beams are associated with one chuck, which can be moved horizontally within the housing window by the synchronized movement of the beams in question. To deflect the work rolls in the vertical direction, each beam, at the end extending into the housing window, accommodates at least one vertically-acting deflecting cylinder that grips behind a projection on the chuck.

In this embodiment, the beams for moving the chucks are inserted through bores, which run in the direction of roll, in the housing columns and are guided in these bores. To elevate the chucks for the purpose of deflecting the work rolls, the deflecting cylinders are arranged at the ends of the beams that extend into the housing window. The deflecting cylinders grip behind projections on the chucks in order to adjust the chucks in the vertical direction. The proposed solution is distinguished by the simplicity of its design. The device can be installed retroactively in existing roll stands. The prerequisite for doing so is adequate housing strength, which is usually found in old stands, in particular. According to another feature of the invention, the beams that are guided in the housing columns are moved by means of horizontally acting movement cylinders. These movement cylinders are connected to the beam ends facing away from the housing window and are externally supported indirectly on the housing columns.

The "beam solution" creates a highly economical and simple mechanical solution, which can easily be used to retrofit old roll stands. The device operates reliably and accurately and permits the work rolls to be deflected and moved in the required setting range. The devices are part of the roll housing and are needed only once for all work rolls. As a result, the required investment capital drops, particularly compared with solutions in which devices for deflecting and crossing the work rolls are associated directly with the work rolls or their chucks.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
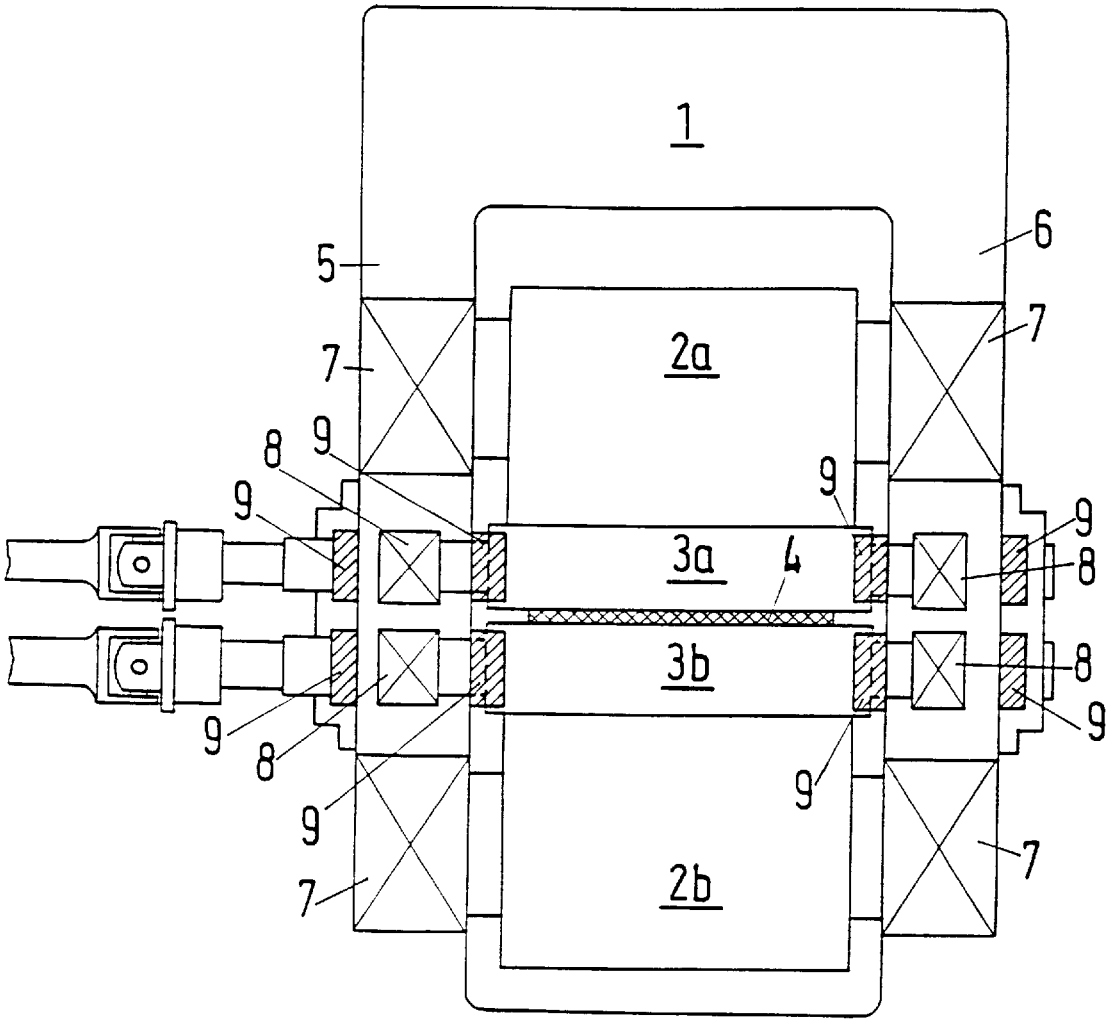
FIG. 1 shows a roll stand with backing rolls and work rolls for rolling sheets with the device according to the invention.

FIG. 1 shows a roll housing 1 of a four-high roll stand with an upper backing roll 2*a*, a lower backing roll 2*b*, an upper work roll 3*a* and a lower work roll 3*b*. The rolling material 4 is also shown. The roll housing 1 has four housing columns, two of which, namely the housing columns 5 and 6, are shown in the drawing. The housing columns on one side of the roll housing 1 delineate between them the housing window 11, in which chucks 7, 8 of the backing rolls 2*a*, 2*b* and the work rolls 3*a*, 3*b*, respectively, are run.

Figure 2:
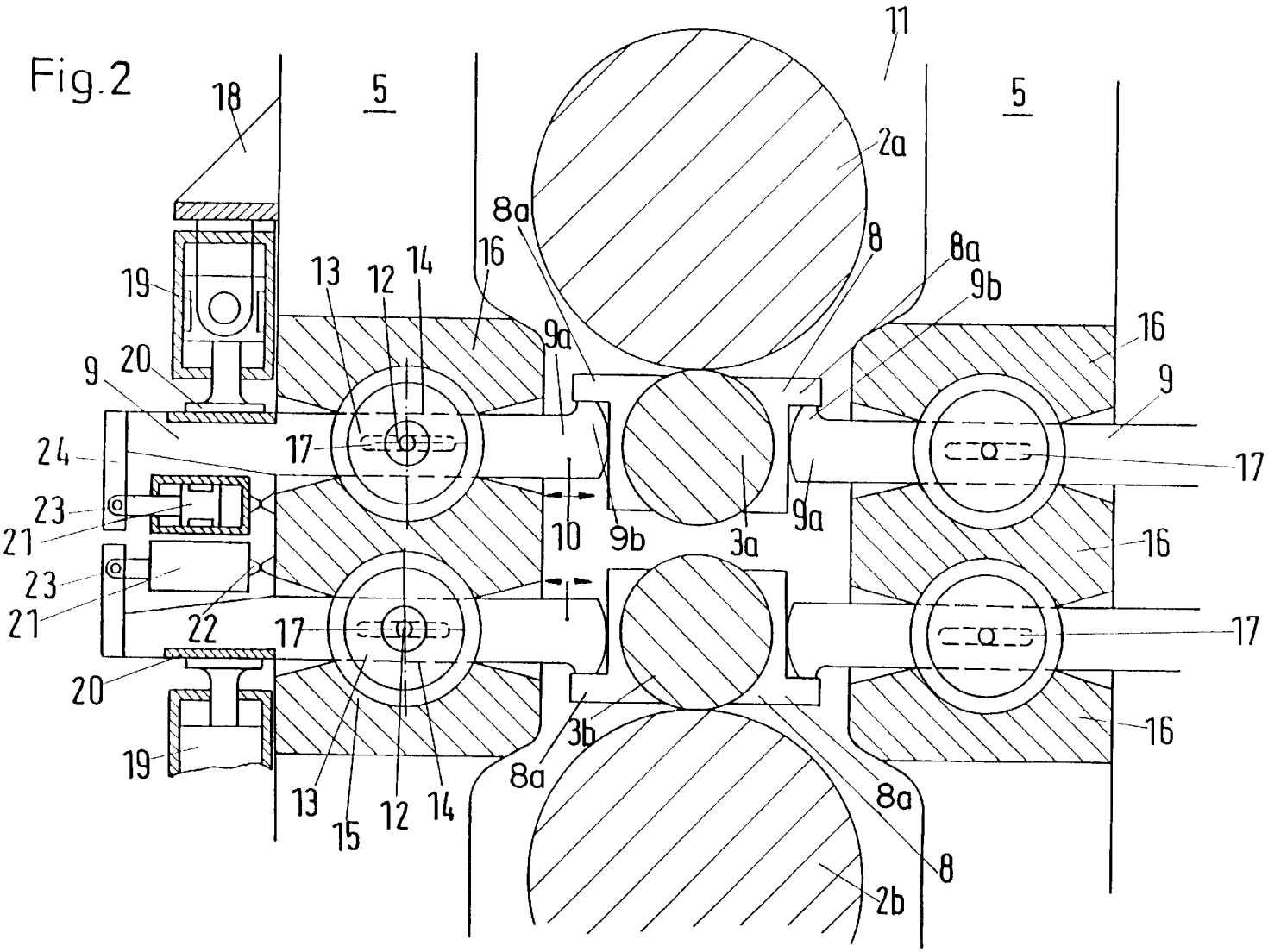
FIG. 2 is an enlarged section through the movement and swivel bearings according to the invention.

On the inner and outer sides of each housing column 5, 6, which run parallel to the direction of roll and are located opposite to each other, there are horizontal beams 9 (running vertical to the plane of the drawing), which are shown in FIG. 1 and will be described below in reference to FIG. 2.

The drawings are simplified depictions, which omit non-essential parts. In FIG. 2, common parts have common reference numbers. FIG. 2 shows the beams 9 of the invention. As the arrow 10 indicates, the beams 9 run essentially horizontally on the housing columns 5 and can be swivelled. The beams 9 extend with their ends 9*a* into the housing window 11 formed between the housing columns 5. At their front ends, the beams 9 hold the chuck 8 of the work roll 3*a* or 3*b* on both sides. At the same time, the ends 9*a* of the beams grip at 9*b* behind projections 8*a* on the chucks 8.

On these projections 8*a*, each chuck 8 of the work rolls 3*a*, 3*b* can be adjusted vertically by swivelling the beams 9. For this purpose, the beams 9 have regions 14 that run in guide bushes 13, which can be swivelled around horizontal swivel axes 12. The guide bushes 13 have penetrations, which form gliding guides, in the longitudinal direction of the beams. The guide bushes 13, for their part, are run in a gliding fashion on their cylindrical outer surfaces 15 in corresponding bearing shells, which are arranged in bearing blocks 16 on the housing columns 5. To permit the beams 9 to swivel around the swivel axes 12, and also to permit the beams 9 to be moved in their longitudinal direction, slots 17 are provided in the beams 9. The longitudinal extension of the slots 17 matches the movement path of the beams 9.

To deflect the work rolls 3*a*, 3*b* with the swivelling the beams 9 around their swivel axes 12, brackets 18 are placed on the housing columns 5. Swivelling deflecting cylinders 19 that act in the vertical direction are linked to the brackets 18. The deflecting cylinders 19 rest, via glide guides 20, against the ends of the beams 9 that extend out on the side of the housing columns 5 facing away from the housing window 11. The deflecting cylinders 19 thus permit swivelling around the swivel axes 12. To move the beams 9 in the longitudinal direction, movement cylinders 21 are provided. On one side 22, the movement cylinders 21 rest on the housing columns 5. On the other side 23, the cylinders 21 rest on cross-traverses 24. The cross-traverses 24 are located at the free ends of the beams 9, in each case connecting two beams to form a beam pair.

Figure 3:
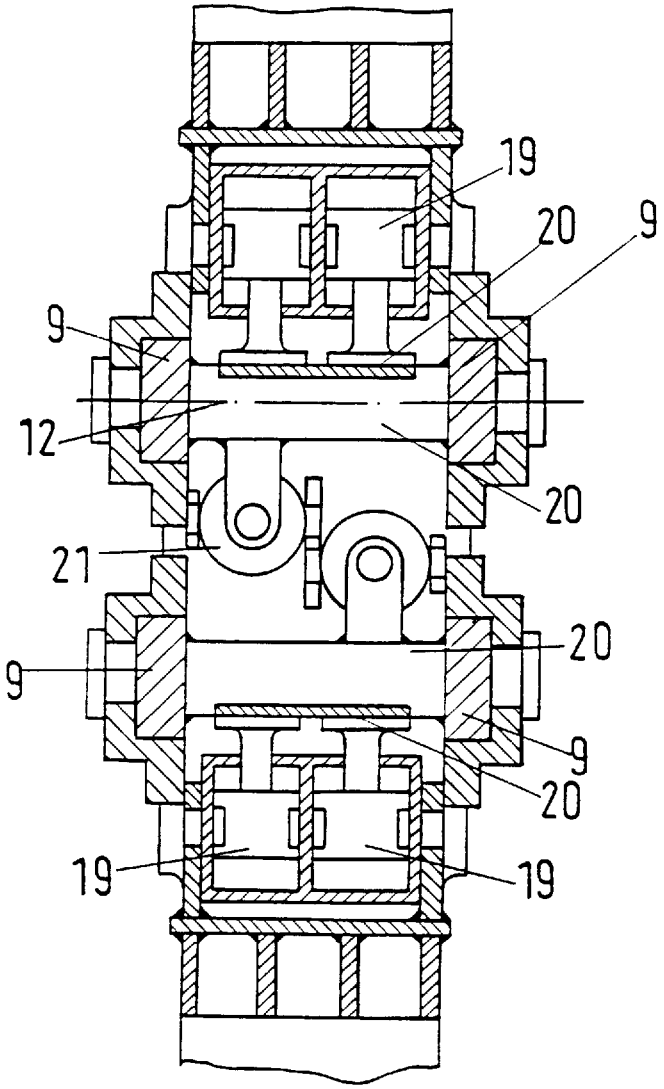
FIG. 3 is a section rotated 90° through the device according to the invention and its deflecting cylinders.

The arrangement of the deflecting cylinders 19, at least two of which are provided, is shown in FIG. 3. FIG. 3, which depicts a longitudinal section through the deflecting cylinders, also shows the arrangement of the movement cylinders 21.

Figure 4:
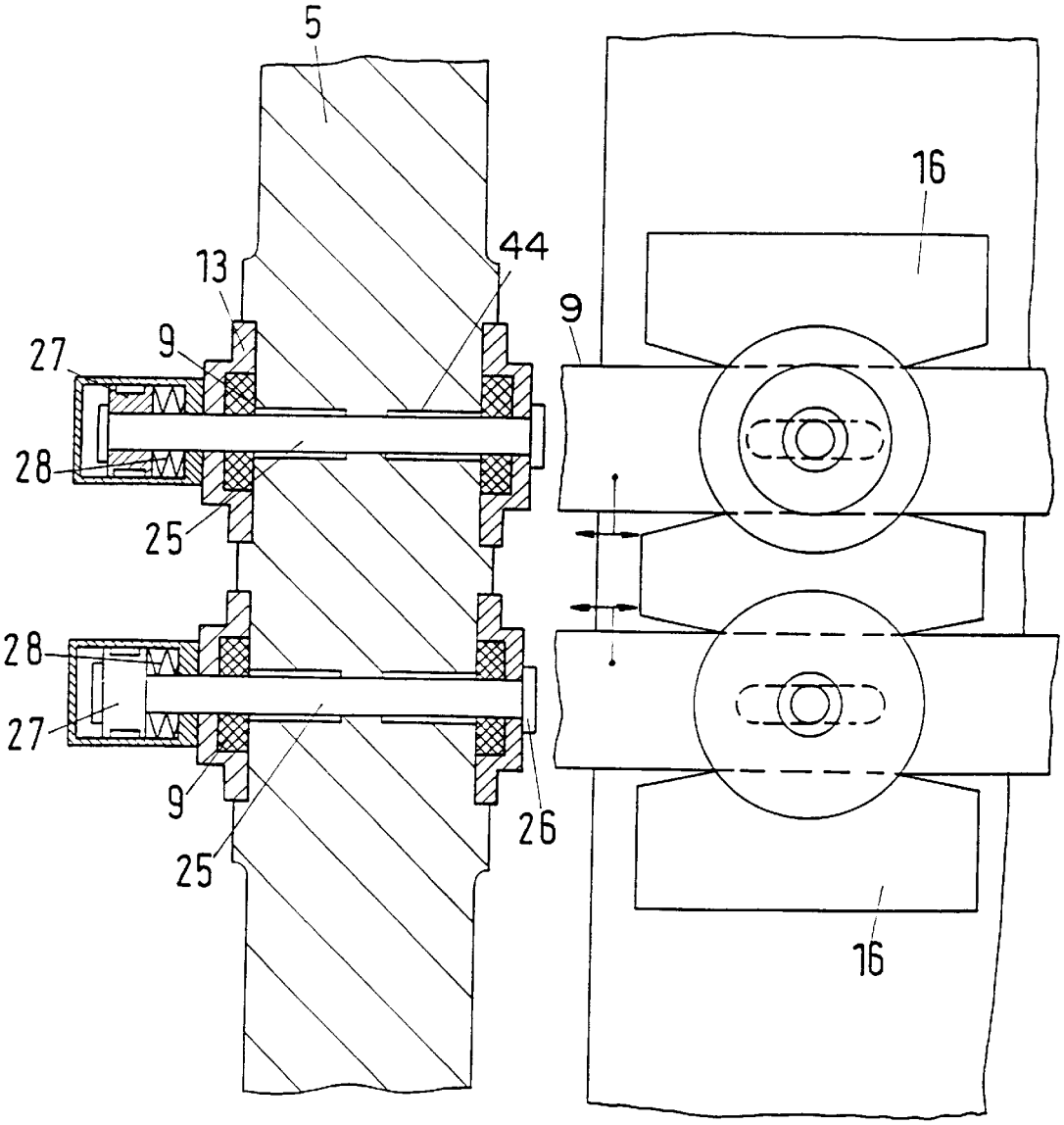
FIG. 4 shows the clamping of the beams via the tension bars.

FIG. 4 shows how the beams 9 are clamped after the movement around their longitudinal axes and thus after the movement of the chucks 8. For this purpose, the housing column 5 of each roll housing 1 has a through-bore 44 and a tension bar 25 is run through the bore 44. The tension bar 25, which penetrates the beams 9 in the region of the slots 17, also penetrates the guide bushes 13. At one end, the tension bar 25 has a head 26 that forms an abutment. At the other end, there is a pressure-medium cylinder 27 as well as disk-spring assemblies 28. The head 26 of the tension bar is tensed via the disk springs 28. The beams 9 are thereby braced and clamped in the guide bushes 13. As a result, the rolls can be fixed during rolling by fixing the chucks 8 between the ends 9*a* of the beams 9. The hydraulic cylinder 27 serves to detach the clamping.

Figure 5:
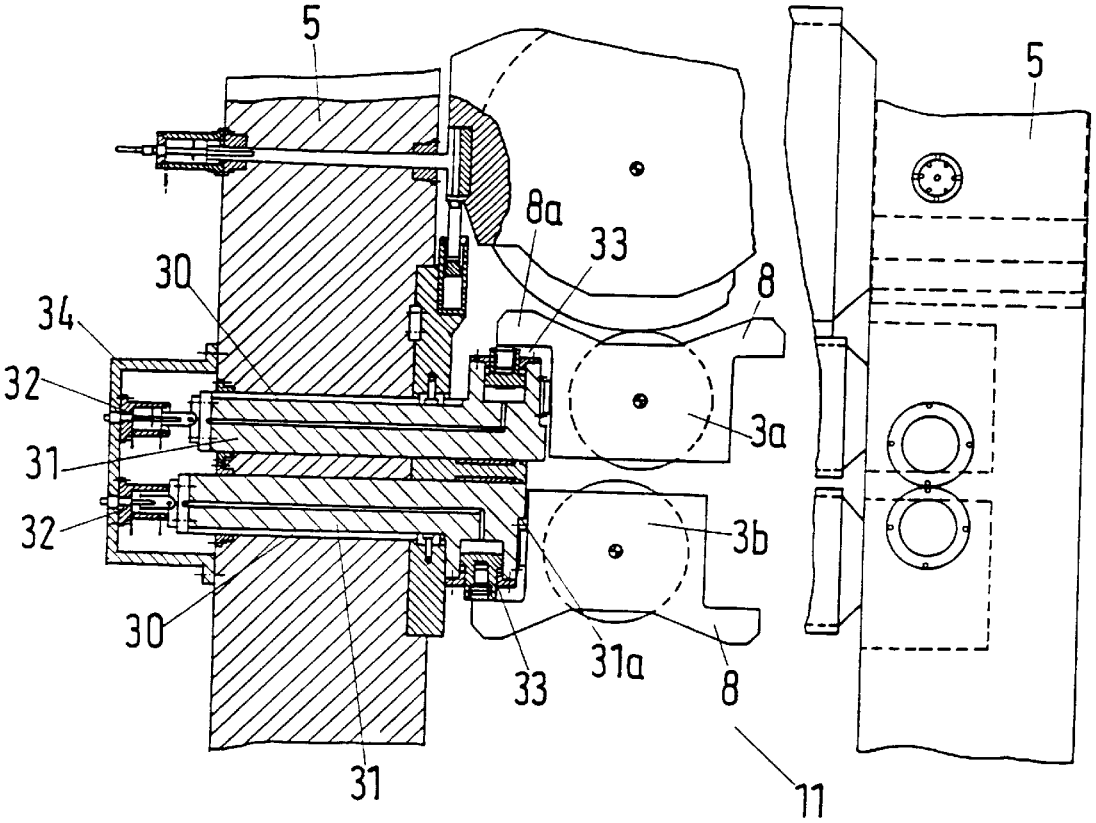
FIG. 5 shows an alternative device for deflecting and crossing the work rolls.

Another embodiment of the invention is shown in FIG. 5. This drawing again shows the housing columns 5 of a four-high roll stand. The housing columns 5 are penetrated by bores 30 in the direction of roll. Movable beams 31 run through the bores 30. At their ends 31*a*, which extend into the housing window 11, the beams 31 fix the chucks 8 of the work rolls 3*a*, 3*b* on both sides in the desired movement setting. To move the beams 31, movement cylinders 32 are provided frontally, outside of the housing columns 5. Coupled to the opposite beams 31, the movement cylinders 32 cause the work rolls 3*a*, 3*b* to be moved via their chucks 8. To adjust the chuck 8 horizontally—and thus to deflect the work rolls 3*a*, 3*b*—the horizontal projections 8*a* on the chucks 8 are gripped by vertically-acting deflecting cylinders 33. The deflecting cylinders 33 are arranged at the beam ends 31*a* extending into the housing window 11. By pressurizing these deflecting cylinder 33, preferably with a pressure medium passed through the beams, it is possible to deflect the work rolls 3*a*, 3*b* in each movement setting of the beams 31 in the borings 30 of the housing columns 5. The movement cylinders 32 for the beams 31 rest via a traverse 34 on the respective housing column 5.

The invention is not limited by the embodiments described above which are presented as examples only but can be modified in various ways within the scope of protection defined by the appended patent claims.

I claim:

1. A roll stand for rolling sheets and strips, comprising:

a roll housing having columns arranged to form housing windows, the columns having inner and outer sides that lie opposite one another and run parallel to a rolling direction;

chucks movably arranged inside the housing windows, each of the chucks having a projecting part;

upper and lower work rolls each having an axis and mounted in the chucks;

backing rolls arranged adjacent the work rolls;

means for moving the chucks so that the work rolls are movable out of a shared vertical plane into positions in which vertical planes that pass through the roll axes of the upper work roll and the lower work roll intersect;

two connected, substantially horizontal beams; and movement and swivel bearing means at the inner and outer sides of each housing column, for supporting the beams parallel to each other, the beams being arranged to extend beyond the columns on both ends so that a first end of each of the beams extends into the housing window, and a second end of each of the beams extends out of the roll housing, the first ends of the beams being configured to support the chuck whereby the chuck is synchronously adjustable vertically and horizontally, the moving means including movement devices and deflecting devices operatively connected to the second ends of the beams so as to at least one of move the beams in opposite directions and swivel the beams around a swivel axis.

2. A roll stand as defined in claim 1, wherein the movement and swivel bearing means includes guide bushes arranged on the housing columns in an axis-parallel manner and with a common axis relative to a housing column so as to be swivellable around their central horizontal axes, and further comprising bearing blocks mounted on the housing columns and having bearing shells, the guides bushes having cylindrical outer surfaces arranged in the bearing shells in a gliding fashion.

3. A roll stand as defined in claim 2, and further comprising a deflecting cylinder operatively arranged to deflect the work rolls, a bracket mounted to the housing column, one end of the deflecting cylinder being mounted to the bracket and another end of the deflecting cylinder being in sliding contact with one of the beams whereby transverse forces are transmitted via the guide bushes and the bearing shells to the housing columns.

4. A roll stand as defined in claim 1, and further comprising traverses arranged to connect the beams together on both sides of the housing columns at a right angle to the beams.

5. A roll stand as defined in claim 2, wherein the guide bushes have a central through-bore perpendicular to the longitudinal axis of the beams, a shared axle being arranged to penetrate the housing columns, the guide bushes being arranged on the shared axle, the beam having a slot that runs in a movement direction of the beam, the axle being configured and arranged to pass through the slot to brace and clamp the beams relative to one another, while detachment is carried out hydraulically.

6. A roll stand as defined in claim 5, wherein the shared axle is a spring-force operated tension bar.

7. A roll stand for rolling sheets and strips, comprising:

a roll housing having columns arranged to form housing windows, the columns having inner and outer sides that lie opposite one another and run parallel to a rolling direction;

chucks movably arranged inside the housing windows, each of the chucks having a projecting part;

upper and lower work rolls each having an axis and mounted in the chucks;

backing rolls arranged adjacent the work rolls; and means for moving the chucks so that the work rolls are movable out of a shared vertical plane into positions in which vertical planes that pass through the roll axes of the upper work roll and the lower work roll intersect the housing columns having through-bores, the moving means including movable beams arranged to extend horizontally through the throughbores of the housing columns into the housing window, two of the beams being coaxially opposite and associated with one of the chucks, the chuck being movable in the housing window by synchronous movement of the beams, the moving means further including at least one vertically-acting deflecting cylinder mounted on first ends of each of the beams that extend into the housing window, so as to engage behind the projecting part of the chuck, whereby actuation of the cylinder vertically deflects the work rolls.

8. A roll stand as defined in claim 7, wherein the beams have second ends that face away from the housing window, and further comprising horizontally-acting movement cylinders supported externally on the housing columns and operatively connected with the second ends of the beams.

* * * * *